United States Patent [19]

Dehnert et al.

[11] Patent Number: 4,830,373

[45] Date of Patent: May 16, 1989

[54] SOCCER BALL

[76] Inventors: Rudolf Dehnert; Peter R. Dehnert, both of 44 Woodcrest La., Milton, N.Y. 12547

[21] Appl. No.: 133,307

[22] Filed: Dec. 16, 1987

[51] Int. Cl.[4] ..... A63B 37/00; A63B 41/00; G09F 3/00

[52] U.S. Cl. ..... 273/58 BA; 273/65 ED; 273/65 EG; 40/327; D21/204

[58] Field of Search ..... D21/204; 273/65 R, 65 E, 273/65 EG, 65 EE, 58 R, 58 B, 58 K, 58 BA, 58 A, 65 ED, 60 R, 60 A, 65, 58

[56] References Cited

U.S. PATENT DOCUMENTS

| | | | |
|---|---|---|---|
| 1,140,845 | 5/1915 | Oliver | 273/65 E |
| 1,161,841 | 11/1915 | Clausen | 273/58 R |
| 1,890,566 | 12/1932 | Bartky | 273/65 E |
| 1,960,803 | 5/1934 | Baumer | 112/267 |
| 2,078,141 | 4/1937 | Hesper | 273/65 |
| 2,258,174 | 10/1941 | Chawner | 273/58 B |
| 4,169,594 | 10/1979 | Crane | 273/58 |
| 4,318,544 | 3/1982 | Brine, Jr. | 40/327 |
| 4,462,590 | 7/1984 | Mitchell | 273/65 E |
| 4,717,158 | 1/1988 | Pennisi | 273/58 A |

FOREIGN PATENT DOCUMENTS

| | | | |
|---|---|---|---|
| 2375878 | 9/1978 | France | 273/58 BA |

*Primary Examiner*—Richard C. Pinkham
*Assistant Examiner*—Gary Jackson
*Attorney, Agent, or Firm*—Schmeiser, Morelle & Watts

[57] ABSTRACT

An improved soccer ball having a star/hexagon cover and a method for stitching same. The star/hexagon cover comprises alternating star-shaped and hexagonal panels stitched together by cross-seams. Each cross-seam is formed by intersecting two standing seams at the point where the apexes of two star-shaped panels meet the vertices of two hexagonal panels without stitching the apexes of the star-shaped panels together. The improved soccer ball construction allows the player to have greater control over the ball due to greater strength, durability, shape retention capability, and grip over the conventional pentagon/hexagon soccer ball.

6 Claims, 2 Drawing Sheets

SOCCER BALL

FIELD OF THE INVENTION

This invention relates generally to soccer balls and, more particularly, to a soccer ball which is constructed to have greater strength, durability, shape retention capability, and grip than the conventional soccer ball.

BACKGROUND AND SUMMARY OF THE INVENTION

As with any ball oriented sport, the integrity and specifications of the play ball is of utmost importance. A soccer ball must meet several criteria, including durability and shape integrity during play. Unlike many other sports such as football, baseball, and the like, soccer is a continuous action game, where the ball may be in actual play for an extended period of time. Furthermore, in soccer, the ball is often kicked, which can cause a deformation that in turn effects the flight path of the ball. Conventional soccer balls have outer covers which comprise a plurality of hexagonal/pentagonal panels stitched together using Y-shaped butt seams. One butt seam joins three panels; thus, the force on impact is distributed over only three panels at each seam. A conventional soccer ball generally contains sixty butt seams.

While there have been improvements in soccer balls, these generally relate to the materials used, such as improved interior bladders and the like. Furthermore, much effort has been directed toward ball designs and the use of exterior appliques to alter the appearance of the ball. Such changes, of course, have no beneficial effect on the functional aspects of the soccer ball but are simply for appearance.

After studying the problems encountered with the present-day pentagonal/hexagonal paneled soccer ball, we determined that increased control, strength, grip and shape retention capabilities could be realized by developing a soccer ball having a cover comprised of panels stitched together with fewer seams, but having an overall increase in total seam length.

After working with a variety of concepts, we developed a combination hexagonal/star arrangement which would not only utilize fewer and longer seams, but would also join four panels together as opposed to the three panel intersections of the present soccer ball. While all indications led to the belief that this would be an improved soccer ball, initial attempts to stitch the ball with this hexagonal/star arrangement failed, the main problem being stitching the intersection of the four panels.

Nevertheless, since our new hexagonal/star arrangement was also aesthetically pleasing, we developed appliques which allowed us to use our configuration over a traditionally stitched soccer ball. Design patents were filled on this configuration, including U.S. Pat. No. Des. 290,632 the disclosure of which is incorporated by reference into this application.

We continued, however, to work on the stitching of our new soccer ball. At one point, we even posed this stitching problem to a well known soccer-ball manufacturer requesting them to manufacture this ball for us if they could find a solution. Their response after numerous attempts was that stitching such a configuration was impossible.

Shortly thereafter, while working on possible stitching configurations, we questioned a previously accepted requirement. Was it necessary to have stitching through the four panel intersection. This approach led to the development of the present invention.

The soccer ball of the present invention has a cover consisting of alternating star-shaped and hexagonal panels. These panels are held together by cross-seams arranged so that a single cross-seam secures four panels to each other with diagonal bypass stitches crossing over instead of through the four panel intersection. Therefore, the force on impact at a seam is distributed over four panels, rather than three as in the conventional design. In addition, although the number of seams required to make a soccer ball cover has been reduced to thirty, the total seam length over the entire ball cover has been significantly increased. The result is a stronger soccer ball, thereby enabling a player to exhibit greater control.

Advantageously, the stitching pattern also makes the ball less susceptible to distortion. Better shape retention is the result of not only the arrangement of seams, but also the fact that the apexes of adjoining stars are not stitched together. A further advantage of the star/hexagonal stitching patternis about a twenty percent increase in the seam length, thereby providing more gripping indents so that the player is able to maintain a better grip on the ball.

The major advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, combinations and improvements herein shown andj described.

The accompanying drawings referred to herein and constituting a part hereof illustrate preferred embodiments of the invention and together with the description, serve to explain principles of the invention.

DETAILED DESCRIPTION OF THE DRAWINGS

Figure 1:
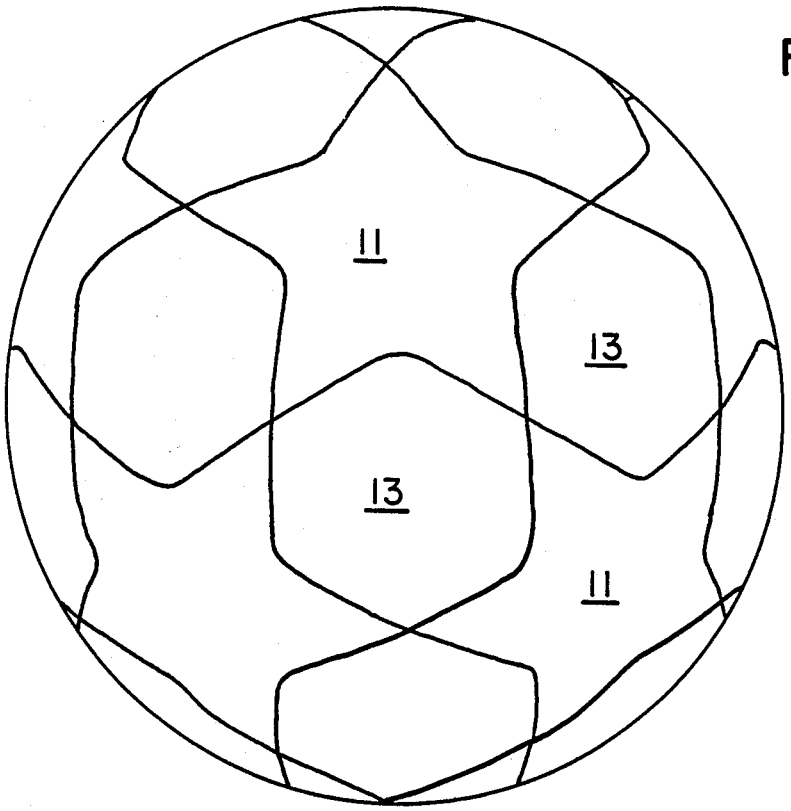
FIG. 1 is an elevational view of the star/hexagon soccer ball of the present invention.

With reference to FIG. 1, a star/hexagonal panel soccer ball stitched in accordance with the present invention is shown. The outer cover of the soccer ball is made of a strong, durable and resilient material, preferably leather which is coated with a water-proofing material such as polyurethane. The cover is molded to a thread-wound carcass over an inner bladder. In the preferred embodiment of the present invention, a two-ply butyl floating bladder is enclosed within a strong, nylon-wound carcass.

The soccer ball cover is made by alternating star-shaped panels 11 and hexagonal panels 13. Each star-shaped panel has five points so that one point of each star is wedged between two opposite edges of a pair of adjacent hexagonal panels. By contrast, the cover of the conventional soccer ball is constructed with a series of hexagonal/pentagonal panels stitched together using Y-shaped butt seams.

In my preferred embodiment, each star has a total area of about 56.5 square centimeters and each hexagon has a total area of about 43.0 square centimeters. Each star point has a base line of about 37 millimeters and the distance from the baseline to the apex of that point is approximately 35.0 millimeters. The distance from the center of the baseline to the center of the star is about 26.0 millimeters. Each side of the hexagon is about 40.5 millimeters and the distance from the center of any side to the center of the hexagon is about 35.5 millimeters.

Figure 3:
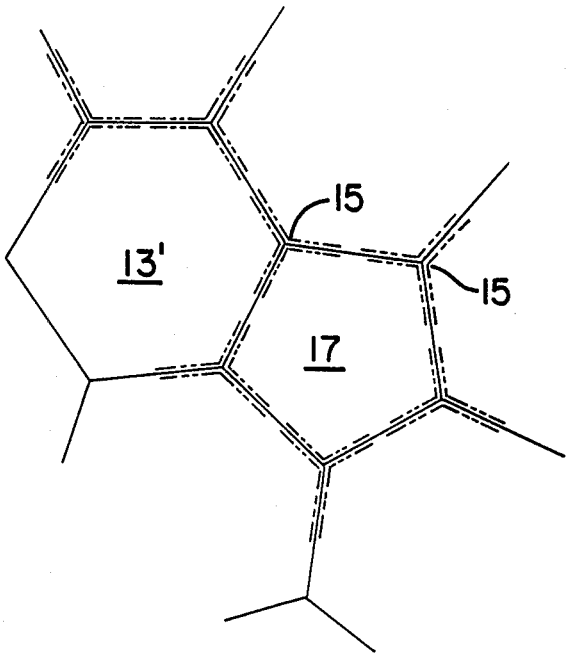
FIG. 3 is a plan view illustrating the Y-shaped butt seams of the conventional soccer ball.
Figure 4:
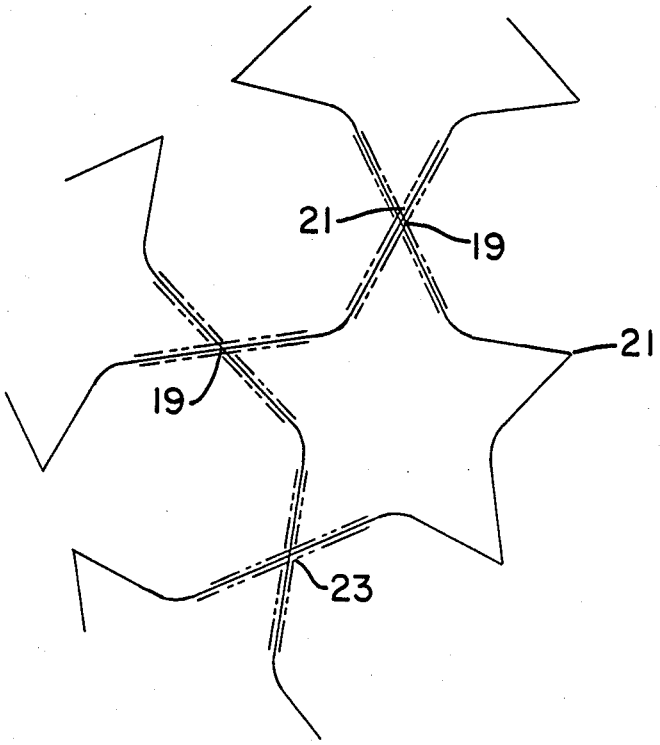
FIG. 4 is a plan view illustrating the cross-seams of the present invention.

As shown in FIG. 3, one butt seam 15 of the conventional soccer ball joins the edges of three adjacent pentagonal panels 17 and hexagonal panels 13. An impact force at the point wherein the three panels meet is fairly uniformly distributed over the three panels. On the other hand, as shown in FIG. 4, (where the panels are shown lying flat) the present invention employs cross-seams 19, which are formed by the intersection of two standing seams, to join four panels of the cover. The apexes 21 of opposite points of two star-shaped panels 11 meet the verticles 23 of two hexagonal panels at the intersection of two standing seams. At that point, an impact force is fairly uniformly distributed over four panels, rather than three. The result is a substantial improvement in impact resistance over the conventional ball, thus a stronger soccer ball. One advantage of a stronger soccer ball is that it will retain shape integrity and may be more easily controlled by a player. Still a further consequence is the increased durability of the soccer ball.

Figure 2:
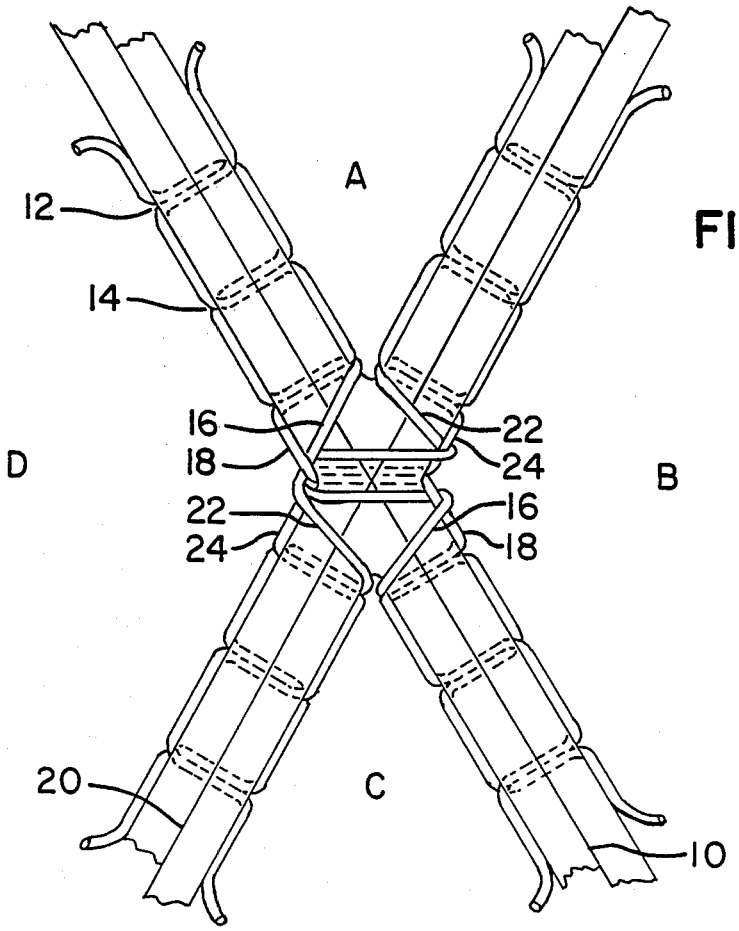
FIG. 2 is an enlarged fragmentary sectional view showing the details of the stitcing and cross-seam.

The stiching method of the present invention entails stitching together four panels (A,B,C and D) at a time by making cross-seams. Each cross-seam is created by stitching two standing seams which intersect at the point where the apexes 21 of two star-shaped panels 11 meet the vertices 23 of two hexagonal panels 13. Referring to FIG. 2, the details of the cross-seam stitching pattern joining four cover panels are shown. Stitches passing through the panels are designated by dashed lines. The first step in the stitching method involves overlapping the edges of two panels, a first star-shaped panel A and a first hexagonal panel D. The overlapping edges extend outwardly, substantially perpendicularly, from the inner surfaces of the panels and form the basis for a standing seam 10. Next, two threaded needles are secured along the overlapping edges near the inner radius of the first star-shaped panel A.

With the threads secured, the overlapping edges are double-stitched together. This is accomplished by drawing the two needles oppositely to each other and through the same location 12 in the overlapping edges. Threads are then pulled parallel to the seam to the next location 14 along the overlapping edges where another stitch is to be made. Double-stitching is continued at specific intervals, 5 millimeters in my preferred embodiment, to secure the overlapping edge portions of the first two panels A and D.

When a location near the apex portion of the point of the first star-shaped panel A is reached, a distance of approximately three to five millimeters from the actual star point apex in my preferred embodiment, the stitching pattern is changed. A diagonal stitch bypassing the apex is made by pulling thread 16 over the top of the standing seam rather than through the overlapping edges. Joining a second hexagonal panel B, a stitch is then made from the vertex portion 23 of the first hexagonal panel D to the vertex portion 23 of a second hexagonal panel B by looping thread 16 around thread 18 and then pulling it over the intersection of the vertices of hexagonal panels B and D. Thread 18 is then pulled through the vertices of hexagonal panels B and D, where these panels are "locked" together by tying knots with threads 16 and 18.

The next step comprises joining a second star-shaped panel C to the second hexagonal panel B while, at the same time, bypassing the apex portion of the point of the second star-shaped panel C to be joined. Again, the bypassing step is accomplished by pulling the thread 16 over the top of the overlapping edges, rather than through them. Thread 16 is then looped around thread 18 to a point near the apex portion of a second star-shaped panel C. It is to be noted that while the vertices of the hexagonal panels B and D are stitched together, the star-shaped panel apexes are not. With the edges of the second hexagonal panel B and the second star-shaped panel C overlapping, the first standing seam 10 is completed by double-stitching to the inner radius of the second star-shaped panel C where the threads are secured.

To form the cross-seam, a second standing seam 20 joining the above-mentioned four panels (A,B,C, and D) is necessary. This second standing seam is formed by: overlapping and double-stitching the now-adjacent edges of the first star-shaped panel A and the second hexagonal panel B; pulling thread 22 over the top of standing seam 20; looping thread 22 around thread 24 and then pulling it over the intersection of the vertices of hexagonal panels B and D; passing thread 24 through the vertices of hexagonal panels B and D, where these panels are "locked" together by tying knots with threads 22 and 24; and, finally, double-stitching the overlapping edges of panels C and D until the inner radius of the second star-shaped panel C is reached where the threads 22 and 24 are secured.

The resulting cross-seam consists of two standing seams 10 and 20 which joint four panels A,B,C, and D and intersect at the point 30 where the vertices of two hexagonal panels B and D meet the apexes of the points of two star-shaped panels A and C. At the point of intersection 30, however, no stitch connects the apex portions of the star-shaped panels A and C. In this way, better shape retention over the conventional ball is achieved.

Thirty cross-seams are required to make the preferred soccer ball cover of the present invention; this is to be compared with the sixty butt seams of the conventional ball. In addition to decreasing the total number of seams, the overall seam length has been increased by about twenty percent over that of the conventional ball. Several advantages are thus achieved by stitching a soccer ball in accordance with the present invention, including increased strength leading to better control as well as the ability of a player to maintain a better grip on the ball.

What is claimed is:

1. A soccer ball, comprising:

an interior core;

a stitched outer cover of durable, resilient material about said core, said cover including a plurality of star-shaped panels arranged point-to-point and a plurality of filler panels to fill the open spaces defined by adjoining star-shaped panels, said star-shaped panels and said filler panels being stitched together; and a valve on said cover for inflating the soccer ball.

2. The invention of claim 1 wherein the apexes of adjoining points of said star-shaped panels are not stitched together.

3. The invention of claim 2 further comprising bypass stitches over the apex portions of the star-shaped panels and through the vertex portions of adjacent filler panels.

4. The invention of claim 3 wherein said star-shaped panels each have five points and wherein said filler panels are hexagonal.

5. The invention of claim 4 wherein said interior core comprises a floating, inflatable bladder which is connected to said cover at said valve.

6. The invention of claim 5 wherein:

said floating bladder is composed of two-ply butyl;

said floating bladder is covered with a nylon thread-wound carcass; and said outer cover is made of leather which is coated with polyurethane.

* * * * *